United States Patent [19]

Webb

[11] 4,413,958

[45] Nov. 8, 1983

[54] APPARATUS FOR INSTALLATION IN WELLS

[75] Inventor: Alan D. Webb, Hinchley Wood, England

[73] Assignee: The British Petroleum Company Limited, London, England

[21] Appl. No.: 169,381

[22] Filed: Jul. 16, 1980

[30] Foreign Application Priority Data

Jul. 18, 1979 [GB] United Kingdom ..... 7925088

[51] Int. Cl.[3] ..... F04B 17/00

[52] U.S. Cl. ..... 417/424; 417/299; 415/501; 166/325; 175/242

[58] Field of Search ..... 417/360, 422, 424, 299, 417/199 A, 426; 166/105, 106, 65 R, 112, 319, 325; 310/87, 67 R; 415/501; 175/242

[56] References Cited

U.S. PATENT DOCUMENTS

| | | | |
|---|---|---|---|
| 516,713 | 3/1894 | Waite | 417/247 |
| 1,811,948 | 6/1931 | Loomis et al. | 417/91 |
| 1,847,885 | 3/1932 | McHardie | 166/106 |
| 1,896,108 | 2/1933 | Simmons | 417/247 |
| 1,949,796 | 3/1934 | Himmel | 103/87 |
| 2,090,127 | 8/1937 | Keegan | 417/257 |
| 2,531,120 | 11/1950 | Feaster | 310/87 W X |
| 2,563,862 | 8/1951 | Nechine | 417/299 |
| 3,196,948 | 7/1965 | Dye | 166/65 |
| 3,384,769 | 5/1968 | Schaefer et al. | 310/87 |
| 3,433,163 | 3/1969 | Sheets | 417/353 |
| 4,021,137 | 5/1977 | Zehren | 415/147 |
| 4,110,059 | 8/1978 | Kling | 417/424 |

FOREIGN PATENT DOCUMENTS

| | | | |
|---|---|---|---|
| 482826 | 5/1929 | Fed. Rep. of Germany | 417/360 |
| 1009928 | 6/1957 | Fed. Rep. of Germany | 417/360 |
| 486572 | 11/1953 | Italy | 310/87 |

*Primary Examiner*—William R. Cline
*Assistant Examiner*—John M. Kramer
*Attorney, Agent, or Firm*—Morgan, Finnegan, Pine, Foley & Lee

[57] ABSTRACT

An electric pump assembly (1) for lifting fluids in wells comprises a plurality of electric pumps (20) and (24) located at axially spaced apart locations in the well each pump having an axial aperture (21) to permit wire line operations to be conducted in the well below the assembly (1). Adjacent pumps (20) and (24) can rotate in opposite directions about a common axis to effect torque balancing. Each pump (20) can have a transformer (50) to permit local adjustment of voltage and means (40) are provided for sequential operation of the pumps. Assembly can be supported on cable (12), (14) or on production tubing (60) assisted by packers.

8 Claims, 11 Drawing Figures

FIG.6
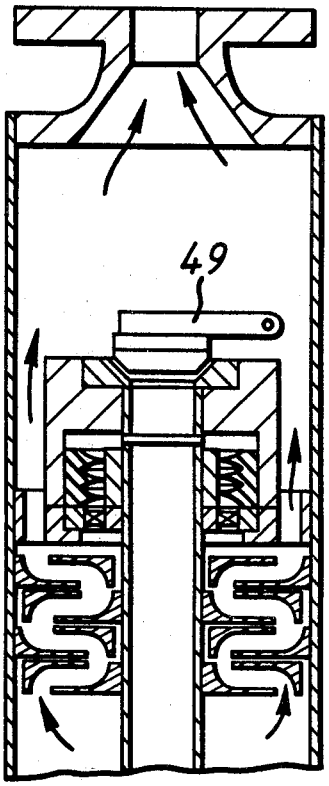
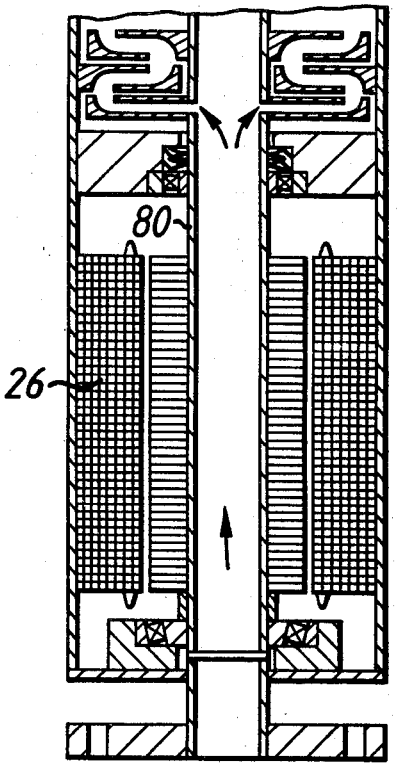
FIG.7

APPARATUS FOR INSTALLATION IN WELLS

This invention relates to an electric pump for lifting fluids such as oil or water in wells.

When oil is produced from a well it is usual for the oil initially to flow up the well to the surface as a result of the pressure existing in the oil bearing formation underground. However, during the producing life of the oil field the pressure underground falls and often a point is reached when the pressure is not sufficient to cause the oil to flow to the surface. One way of maintaining the flow of oil has been to install an electric pump in the well, usually at a depth which is near the oil bearing formation typically from 1,000 to 10,000 feet, and employ the pump to lift the oil to the surface. The pump is usually of high power, for example, several hundred horsepower. A pump of this power may be up to 150 feet in length whilst only about 8 inches in diameter. A pump with these dimensions can be difficult to install particularly in a deviated well. One solution to this difficulty would be to have a plurality of smaller pumps located at axially spaced apart positions in the well but with pumps of conventional design. Failure of a single pump would stop production from the well completely. Conventional pumps also have the disadvantage in that wire line techniques cannot be employed with the pump in the well. As a result a downhole safety valve cannot be operated below the pump and it is necessary to mud the well when the pump is withdrawn.

An electric pump has now been devised which by the provision of an aperture axially therethrough will permit wire line operations to be conducted in the well and will allow the passage of well fluids therethrough in the event of pump failure.

Thus, according to the present invention, there is provided an electric pump suitable for location in a well to lift fluids in the well, the pump having an aperture extending lengthwise therethrough to allow wire line or like operations to be conducted in the well below the pump.

Conveniently the electric motor of the pump is arranged so that its stator is fixed and central with respect to its rotor, the stator being in the form of an annulus to provide the aperture extending therethrough, although the arrangement can be reversed.

According to one embodiment of the present invention an electric pump unit comprises a plurality, conveniently two, electric pumps as hereinbefore defined connected together so that they rotate in opposite directions to effect torque balancing.

The electric pumping units can be located at intervals in the well and connected by cable or tubing.

Thus according to a preferred embodiment of the present invention, an electric pump assembly suitable for installation in an oil well to lift oil in the well comprises a plurality of electric pumps as hereinbefore defined the pumps being maintained at axially spaced apart positions by connecting means to permit wire line operations to be conducted in the well below the assembly.

The connecting means can conveniently be tubular.

The upper portion of the assembly may include electric cables (preferably two or more) which can be employed both to feed electric power and to support the assembly in the well. Conveniently however, part of the weight of the assembly is supported by means of packers which engage the walls of the well.

According to another aspect of the present invention a method of lifting oil in a well comprises employing an electric pump as hereinbefore defined.

The electric pump assembly according to the invention is illustrated by reference to the accompanying drawings in which:

FIGS. 6 and 7 are vertical sections of an alternative embodiment of electric pump having a hollow rotating shaft with static casing.

Figure 1:
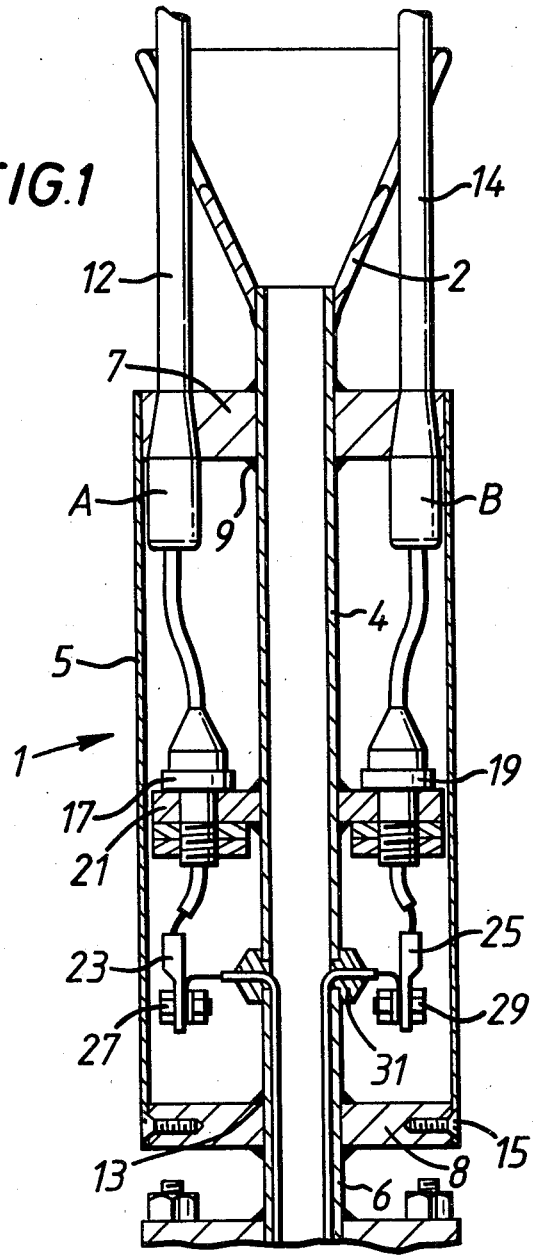
FIG. 1 is a vertical section showing the suspension of the assembly by cable and the connection of the cables to a cable termination box.
Figure 2:
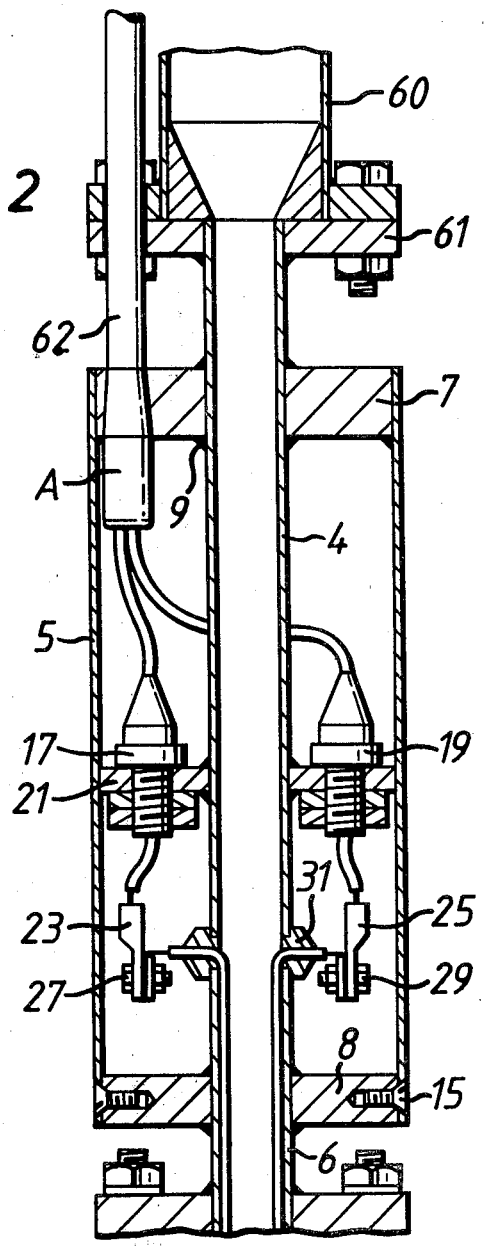
FIG. 2 is a vertical section of an alternative arrangement in which the assembly is suspended by production tubing.
Figure 3:
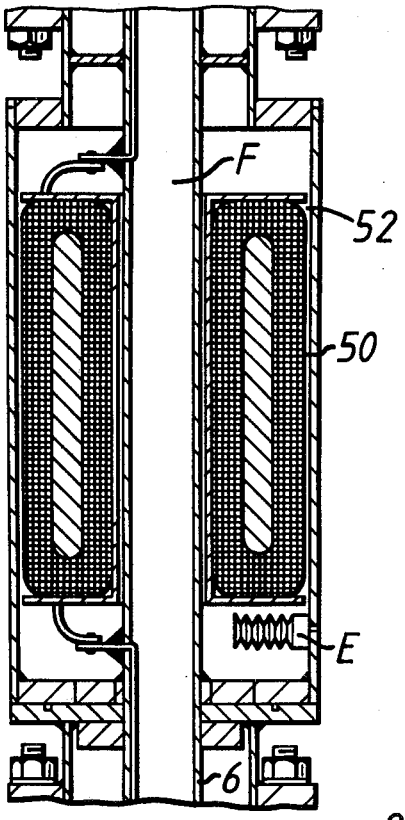
FIG. 3 is a vertical section of a unit transformer, which each motor is provided with, to permit local adjustment of voltage to accommodate supply cable voltage drop.
Figure 4:
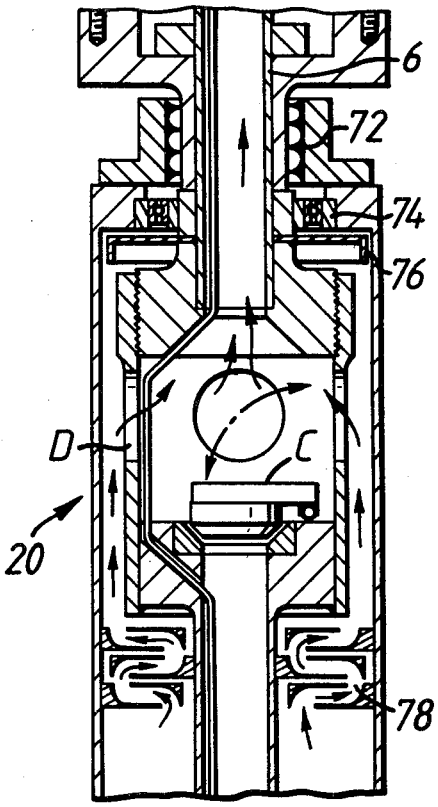
FIG. 4 is a vertical section of the upper portion of one embodiment of pump having a hollow static shaft and rotating casing showing the impellers and flow of fluids.
Figure 5:
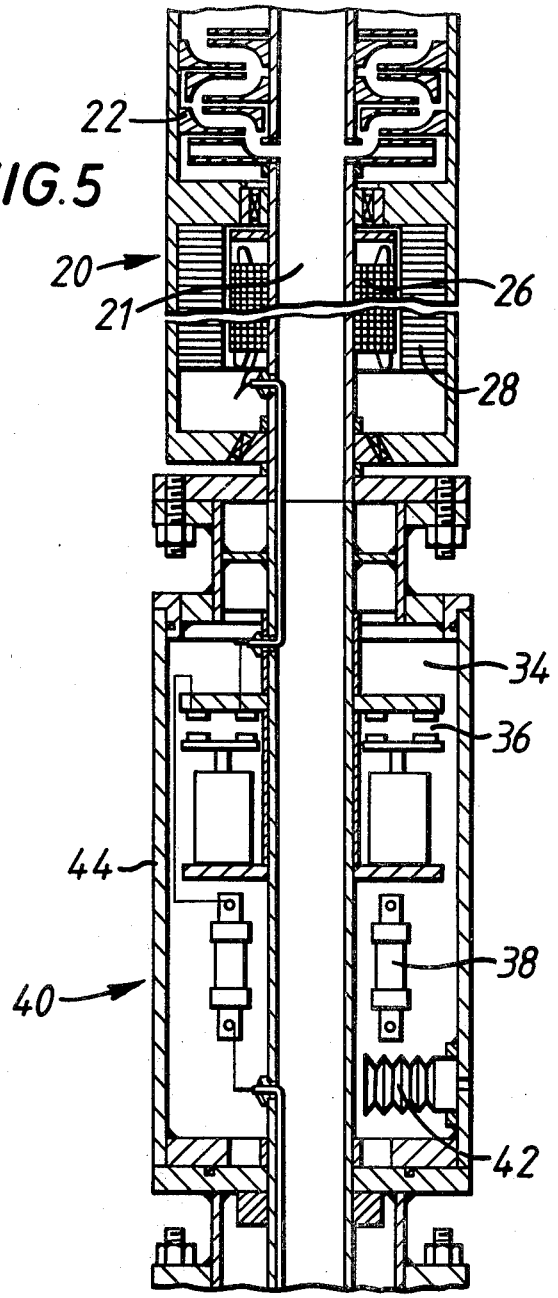
FIG. 5 is a vertical section of the lower portion of the pump shown in FIG. 4 showing the electric motor and also showing its associated bolt on starter/contactor package.
Figure 10:
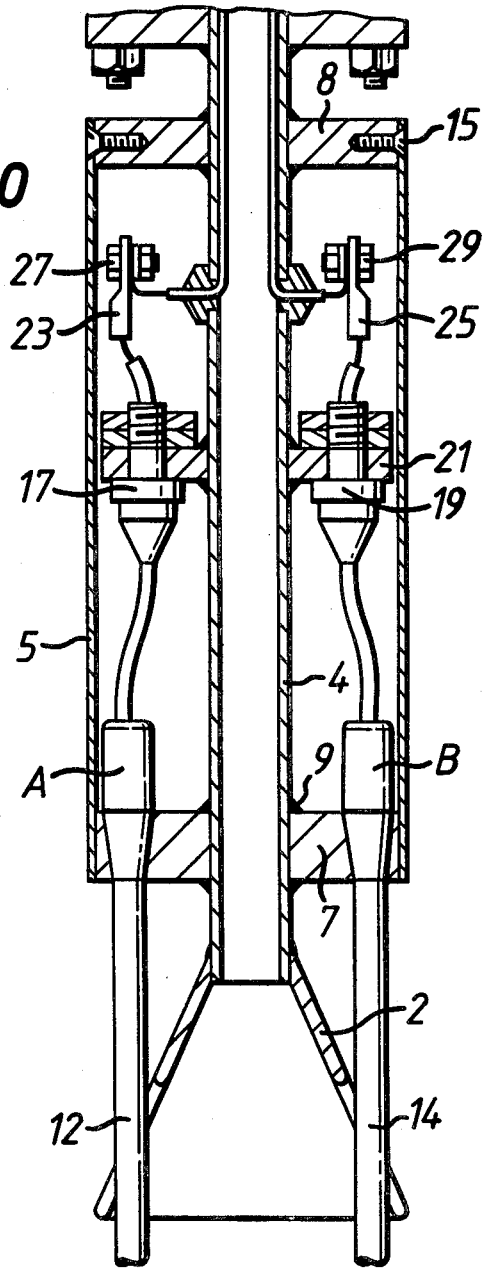
FIG. 10 is a vertical section of the cable termination box (an inverted view of FIG. 1)
Figure 11:
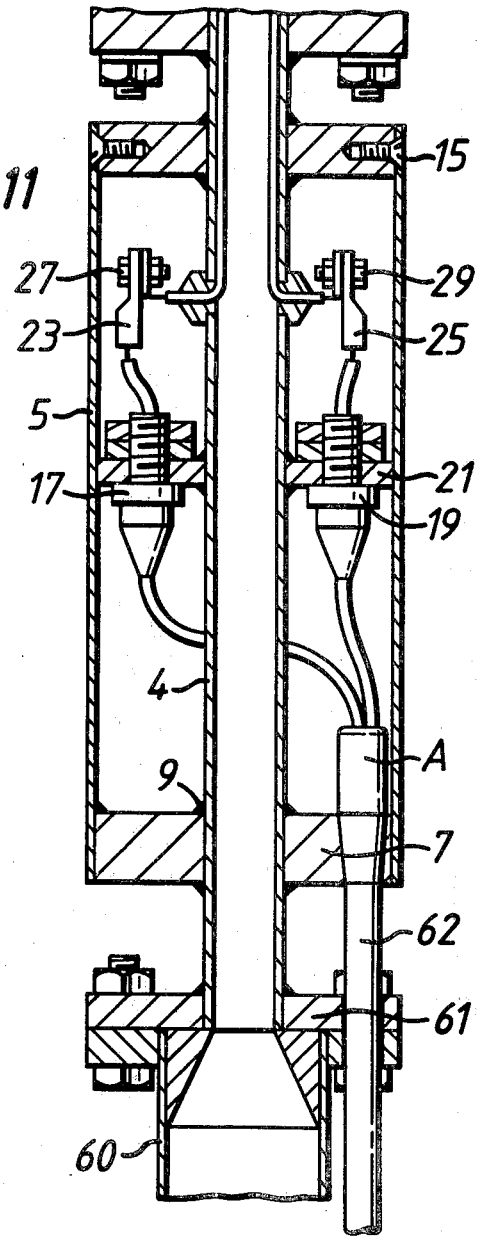
FIG. 11 is an inverted view of FIG. 2.

The entire assembly which is lowered into a well is made up by joining FIG. 1 or 2 endwise with FIG. 3, and FIG. 3 with FIG. 4 or 6, therewith FIG. 5 or 7 respectively, and finally with FIG. 10 or 11.

Referring to FIG. 1 an assembly indicated generally by numeral 1 comprises a guide funnel 2 for wire line operations connected to the upper end of tubing 4. Surrounding and coaxial with tubing 4 is an outer sleeve 5 having an upper end plate 7 welded to tubing 4 at weld 9 and lower end plate 8 welded to tubing 4 at weld 13. Outer sleeve 5 is held to end plate 8 by screws 15. Electrical power is supplied by three cables symmetrically disposed about the axis of the assembly, only two cables 12 and 14 being shown. The cables are also used to lower the assembly into the well. Cable strain member terminations A and B of cables 12 and 14 pass through the end plate 7. Above end plate 7 cables 12 and 14 are in tension, below plate 7 they are not. The cables pass to cable penetrators 17 and 19 supported in the annulus between tubing 4 and outer sleeve 5 by an annular plate 21 welded to tubing 4. The cables then pass to cable thimbles 23 and 25 located in compound filled terminal box and thence to terminals 27 and 29, from where they pass through electrical penetrators 31 and down the interior of tubing 4 to the pump below.

Figure 8:
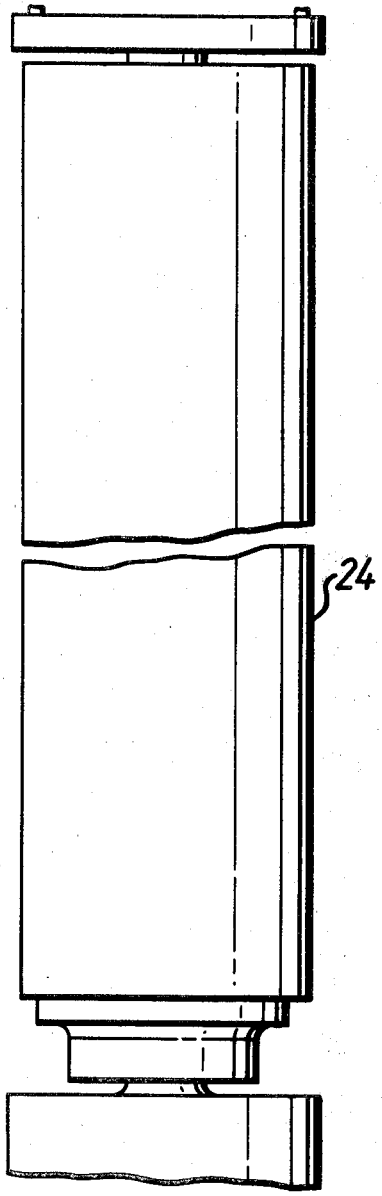
FIG. 8 is an elevation of an electric pump similar to that shown in section in FIGS. 4 and 5.
Figure 9:
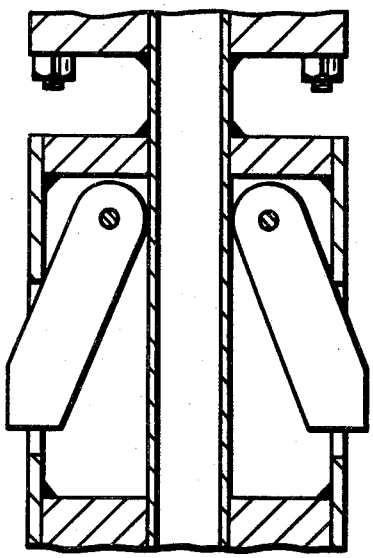
FIG. 9 is a vertical section showing the packers to assist supporting the pump in the well.

Referring to FIG. 2 the assembly 1 is suspended on production tubing 60 which is connected to a plate 61 welded to tubing 4. A single multicore cable 62 runs down the annulus between tubing 60 and casing (not shown) and is connected to cable penetrators 17 and 19. Located below the upper assembly 1 is a transformer 50 working in a sealed enclosure 52 (see FIG. 3). The enclosure is filled with a dielectric liquid such as transformer oil. The liquid dielectric is maintained in a state of pressure balance with respect to external pressures by means of sealed bellows E. The transformer has a central axial tubular conduit F to permit passage of wire line tools and well fluids. A pump indicated generally by numeral 20 (FIG. 4) is located below the upper assembly 1 and connected thereto by tubing 6. The pump 20 comprises an upper pump 22 shown in section and a lower pump 24 shown in elevation (FIG. 8) arranged to rotate in opposition to each other, the stators (only one of which 26 is shown) being wound in series so each takes the same current but generating contrarotational torque. Each stator 26 has an annular squirrel cage rotor 28.

The package 40 is interposed between the upper pump 22 and the lower pump 24 and comprises a tubular housing 44 defining an oil filled enclosure 34 within which is a three phase electrical contactor 36 and a fuse arrangement 38 including an overload relay and a pressure balancing bellows 42.

Referring to FIG. 4 a pump indicated generally by 20 has a seal 72, bearing 74 and a slinger disc 76 to keep bearing 74 clean.

Clapper valve C is biased in the open position so that when the pump is stationary the valve is open. On start up the wash of oil through ports D closes the valve C. This permits flow of oil through a stationary pump in the event of pump failure.

An arrangement indicated by numeral 78 is a conventional centrifugal system of impellers and diffusers the inside ones being stationary, the the outer ones running.

FIG. 5 illustrates an alternative arrangement in which there is a hollow rotating shaft 80 and static casing.

Referring to FIG. 5 the bolt on starter/contactor package indicated generally by numeral 40 is provided to (i) enable pump units in the string to be operated and controlled individually, (ii) to permit adjustment of production flow rate, (iii) to reduce starting current by operating in cascade (i.e. one after the other), and (iv) permit isolation of a faulty unit.

The electric pump system described above with reference to the drawings has the following advantages:

(1) access through the pump system for wire line operations is provided by the tubing, (2) adjacent motors or pairs of motors can be arranged to contrarotate to give torque balancing, (3) failure of one pump unit pair will not stop production: system can operate until pump unit can be replaced, (4) supporting the assembly on two (or three) cables reduces risk of dropping and breakages of the system. The use of two (or three) cables also keeps the cables to the periphery of the casing and gives clear access for wire lining, (5) the two stators are wound in series on one starter circuit, so each takes the same current, (6) a frequency converter (e.g. solid state unit) can be employed for each pump unit to provide pump speed adjustment for efficiency, (7) a transformer is incorporated with each pump unit to provide compensation for voltage drop in the supply cables, (8) as an alternative to suspension of the pump within the well casing by the cables, the pump or pumps can be lowered into the well on a production tubing being a continuous extension of the pump tubing 4.

I claim:

1. An electric pump suitable for location in a well to lift fluids in the well, the pump having an electric motor comprising a rotor and a stator, the stator being fixed and internal with respect to the rotor and having a central aperture extending axially therethrough of a dimension sufficient to permit wire line operations to be conducted through the aperture in the well below the pump, the rotor having a plurality of fluid impellers attached thereto, the pump further comprising a non-return valve located in said aperture and biased in the open position when the pump is inoperative but closable by the wash of well fluids when the pump is working.

2. An electric pump assembly suitable for installation in an oil well to lift oil in the well comprising a plurality of electric pumps as claimed in claim 1 the pumps being maintained at axially spaced apart positions by connecting means to permit wire line operations to be conducted in the well below the pump assembly.

3. An electric pump assembly as claimed in claim 2 wherein adjacent pumps or pairs of pumps are arranged to rotate in opposite directions about a common axis to improve torque balancing.

4. An electric pump assembly as claimed in claim 2 wherein each pump is provided with a transformer to permit local adjustment of voltage to accommodate supply cable voltage drop.

5. An electric pump assembly as claimed in claim 2 wherein means are provided for controlling the operation of the pumps individually to permit operation of the pumps sequentially.

6. An electric pump assembly as claimed in claim 2 wherein the pump assembly is suspended on cable.

7. An electric pump assembly as claimed in claim 6 wherein the cable suspension comprises three cables symmetrically disposed with respect to the axis of the well.

8. An electric pump assembly as claimed in claim 2 wherein packers are provided to engage the sides of the well to assist in supporting the pump assembly in the well.

* * * * *